US008444151B2

(12) United States Patent
Moran et al.

(10) Patent No.: US 8,444,151 B2
(45) Date of Patent: May 21, 2013

(54) LAUNCH AND TARGET GAME

(75) Inventors: Steven M. Moran, Woodland Hills, CA (US); Stephen P. K. Lau, Torrance, CA (US); Jeremy R. Fischer, Long Beach, CA (US); Alan Chung Chi Cheung, Maonshan (HK); Vincent Chen Wen Yong, LeChang (CN); Tom Lee Tai To, San Po Kong (HK); Erick Huang Shi Xiong, Zhangjiang (CN); Edmond Jiang Xiao Dong, Shen Zhen (CN)

(73) Assignee: Mattel, Inc., El Segundo, CA (US)

( * ) Notice: Subject to any disclaimer, the term of this patent is extended or adjusted under 35 U.S.C. 154(b) by 0 days.

(21) Appl. No.: 13/300,188

(22) Filed: Nov. 18, 2011

(65) Prior Publication Data

US 2012/0161397 A1 Jun. 28, 2012

Related U.S. Application Data

(60) Provisional application No. 61/417,052, filed on Nov. 24, 2010.

(51) Int. Cl.
*A63F 7/00* (2006.01)
*A63F 9/26* (2006.01)

(52) U.S. Cl.
USPC ..... 273/450; 273/445; 273/449; 273/459

(58) Field of Classification Search
USPC ..... 273/340, 440, 445, 449, 459, 317, 273/348, 359
See application file for complete search history.

(56) References Cited

U.S. PATENT DOCUMENTS

| | | | | |
|---|---|---|---|---|
| 179,483 | A | 7/1876 | Lewis | |
| 680,175 | A * | 8/1901 | Reinhart | 273/355 |
| 732,281 | A * | 6/1903 | Durboraw | 273/355 |
| 1,542,012 | A * | 6/1925 | Spilman | 273/348 |
| 1,542,063 | A * | 6/1925 | Knight | 273/399 |
| 1,862,877 | A | 6/1932 | Anderson et al. | |

(Continued)

FOREIGN PATENT DOCUMENTS

| | | |
|---|---|---|
| DE | 1857421 | 8/1962 |
| DE | 7625750 | 3/1977 |
| DE | 102007026855 | 12/2007 |

OTHER PUBLICATIONS

United Kingdom Intellectual Property Office, Combined Search and Examination Report under Sections 17 and 18(3) for application No. GB1120298.3; Mar. 26, 2012; six pages. (UK application No. GB1120298.3, publication No. GB2485900, corresponds to U.S. Appl. No. 13/300,188.).

(Continued)

*Primary Examiner* — Raleigh W Chiu
(74) *Attorney, Agent, or Firm* — Kolisch Hartwell, PC

(57) ABSTRACT

An apparatus for playing a game is provided. The apparatus may include a base, a plurality of projectiles and a first target platform moveable with respect to the base. The first target platform may include a collecting position, in which the plurality of projectiles are collected at the first target platform, and a dispersing position, in which the plurality of projectiles are dispersed from the first target platform. The apparatus may further include an actuator mechanism configured to actuate movement of the first target platform from the collecting position to the dispersing position and a first launcher attached to the base and configured to project the plurality of projectiles toward the first target platform.

20 Claims, 5 Drawing Sheets

U.S. PATENT DOCUMENTS

| | | | | | |
|---|---|---|---|---|---|
| 2,044,994 | A | | 6/1936 | Pierce | |
| 2,147,502 | A | | 2/1939 | Savage | |
| 2,424,016 | A | | 7/1947 | Botts | |
| D169,400 | S | | 4/1953 | Wales | |
| 2,799,502 | A | | 7/1957 | Isakson | |
| 2,878,801 | A | | 3/1959 | Patchin et al. | |
| 3,445,114 | A | | 5/1969 | Fernandez | |
| 3,565,432 | A | * | 2/1971 | Reiner et al. | 273/412 |
| 3,601,402 | A | | 8/1971 | Kohner | |
| 3,622,160 | A | | 11/1971 | Barfield | |
| 3,722,494 | A | | 3/1973 | Slevin | |
| 3,724,855 | A | | 4/1973 | Chu | |
| 4,111,179 | A | | 9/1978 | Hashimoto | |
| 4,135,715 | A | | 1/1979 | Soulos | |
| 4,174,835 | A | | 11/1979 | Breslow et al. | |
| 4,177,992 | A | | 12/1979 | Todokoro | |
| 4,243,227 | A | | 1/1981 | Strongin | |
| 4,245,842 | A | | 1/1981 | Kuna et al. | |
| 4,253,669 | A | * | 3/1981 | Ferris et al. | 273/368 |
| 4,449,711 | A | | 5/1984 | Calloway | |
| 4,826,176 | A | | 5/1989 | Kobayashi | |
| 5,150,898 | A | | 9/1992 | Hochberg et al. | |
| 5,181,727 | A | * | 1/1993 | Fukumura | 273/450 |
| 5,265,884 | A | | 11/1993 | Stein | |
| 5,344,156 | A | | 9/1994 | Levin | |
| 5,403,016 | A | | 4/1995 | Kudo | |
| 5,419,566 | A | | 5/1995 | Byrd | |
| 5,423,552 | A | | 6/1995 | English | |
| 5,435,570 | A | * | 7/1995 | Labrasseur | 273/355 |
| 5,676,120 | A | | 10/1997 | Joseph | |
| 5,769,424 | A | | 6/1998 | Kelly et al. | |
| 5,788,242 | A | | 8/1998 | Rudell et al. | |
| 5,882,010 | A | | 3/1999 | Geror | |
| 6,102,405 | A | | 8/2000 | Spikes | |
| 6,149,494 | A | * | 11/2000 | Yang | 446/441 |
| 6,669,200 | B1 | | 12/2003 | Knetsch et al. | |
| 6,837,769 | B1 | | 1/2005 | Skov et al. | |
| 6,889,678 | B1 | | 5/2005 | Oltmann | |
| RE40,580 | E | | 11/2008 | Mitvalsky | |
| 7,722,049 | B2 | | 5/2010 | Williams et al. | |
| 7,845,645 | B1 | | 12/2010 | Chu et al. | |
| 8,181,964 | B2 | * | 5/2012 | Ritter et al. | 273/445 |
| 8,210,896 | B2 | | 7/2012 | Wittenberg | |
| 2001/0035613 | A1 | | 11/2001 | Knetsch et al. | |
| 2002/0037771 | A1 | | 3/2002 | Tamura et al. | |
| 2007/0187891 | A1 | | 8/2007 | Hoeting | |
| 2012/0032402 | A1 | | 2/2012 | Comee | |
| 2012/0161397 | A1 | * | 6/2012 | Moran et al. | 273/359 |

OTHER PUBLICATIONS

German Patent Office, Office Action for German Application No. 102011119069.8, Nov. 8, 2012, 14 pages.

United Kingdom Intellectual Property Office; Second Examination Report for GB1120298.3; Jan. 14, 2013; 4 pages.

* cited by examiner 30
54
32
56

37
46
58
42
60

37
30
32
33
38
36
52
40
54
16
29
θb
28
θa
12
46
14
34
35
60
62
32
52
58

62
58
64
18

LAUNCH AND TARGET GAME

CROSS-REFERENCE TO RELATED APPLICATIONS

This application claims priority to U.S. Provisional Patent Application Ser. No. 61/417,052, filed Nov. 24, 2010 and entitled CATAPULT AND TARGET GAME, the disclosure of which is incorporated herein by reference.

FIELD OF THE DISCLOSURE

The present disclosure is directed generally to target-type games and, more particularly, to a launch and target game including one or more launchers for projectiles and one or more target platforms.

BACKGROUND OF THE DISCLOSURE

Examples of games and/or target-type games are disclosed in U.S. Pat. No. 4,245,842, U.S. Pat. No. 5,265,884, U.S. Pat. No. 5,769,424 and U.S. Pat. No. 5,788,242. The disclosures of these and all other publications referenced herein are incorporated by reference in their entirety for all purposes.

SUMMARY OF THE DISCLOSURE

In the disclosed embodiments, the game may be configured to look like a waiter balancing a tray in either arm, wherein each tray receives projectiles shaped like food items from one of a plurality of launchers. For example, the projectiles may include a bottom bun, a burger, a cheese, a lettuce, a tomato and a top bun.

Other embodiments may have any other appearance, theme and/or context known to those skilled in the art. For example, some embodiments of the game may be configured to look like an acrobat practicing the art of Chinese acrobatic theater plate balancing and/or spinning. Alternative embodiments may include animal figures flipping rings onto a platform or target, or animal figures bumping balls into a cavity or platform. In yet another embodiment, the targets may rotate and/or pivot in multiple axis, creating a moving target.

In one example, an apparatus for playing a game is provided. The apparatus may include a base, a plurality of projectiles and a first target platform moveable with respect to the base. The first target platform may include a collecting position, in which the plurality of projectiles are collected at the first target platform, and a dispersing position, in which the plurality of projectiles are dispersed from the first target platform. The apparatus may further include an actuator mechanism configured to actuate movement of the first target platform from the collecting position to the dispersing position and a first launcher attached to the base and configured to project a projectile toward the first target platform.

A further example of an apparatus for playing a game is provided. The apparatus may include a base, a projectile including a convex surface and a first target platform moveable with respect to the base and including a target cavity configured to at least partially retain the convex surface of the projectile. The apparatus may further include an actuator mechanism configured to actuate movement of the first target platform and a first launcher attached to the base and configured to project the projectile toward the first target platform.

A further example of an apparatus for playing a game is provided. The apparatus may include a base, and a plurality of projectiles, at least one of the projectiles including a convex surface. The apparatus may further include a first target platform disposed above the base and including a target cavity configured to at least partially retain the convex surface of the at least one of the projectiles, and a second target platform disposed above the base and including a target cavity configured to at least partially retain the convex surface of the at least one of the projectiles. The apparatus may further include a first launcher attached to the base and configured to project one or more of the plurality of projectiles to the first target area such that a stack of projectiles is collected at the first target area, and a second launcher attached to the base and configured to project one or more of the plurality of projectiles to the second target area such that a stack of projectiles is collected at the second target area.

Advantages of the present disclosure will be more readily understood after considering the drawings and the Detailed Description.

DETAILED DESCRIPTION OF THE DISCLOSURE

Figure 1:
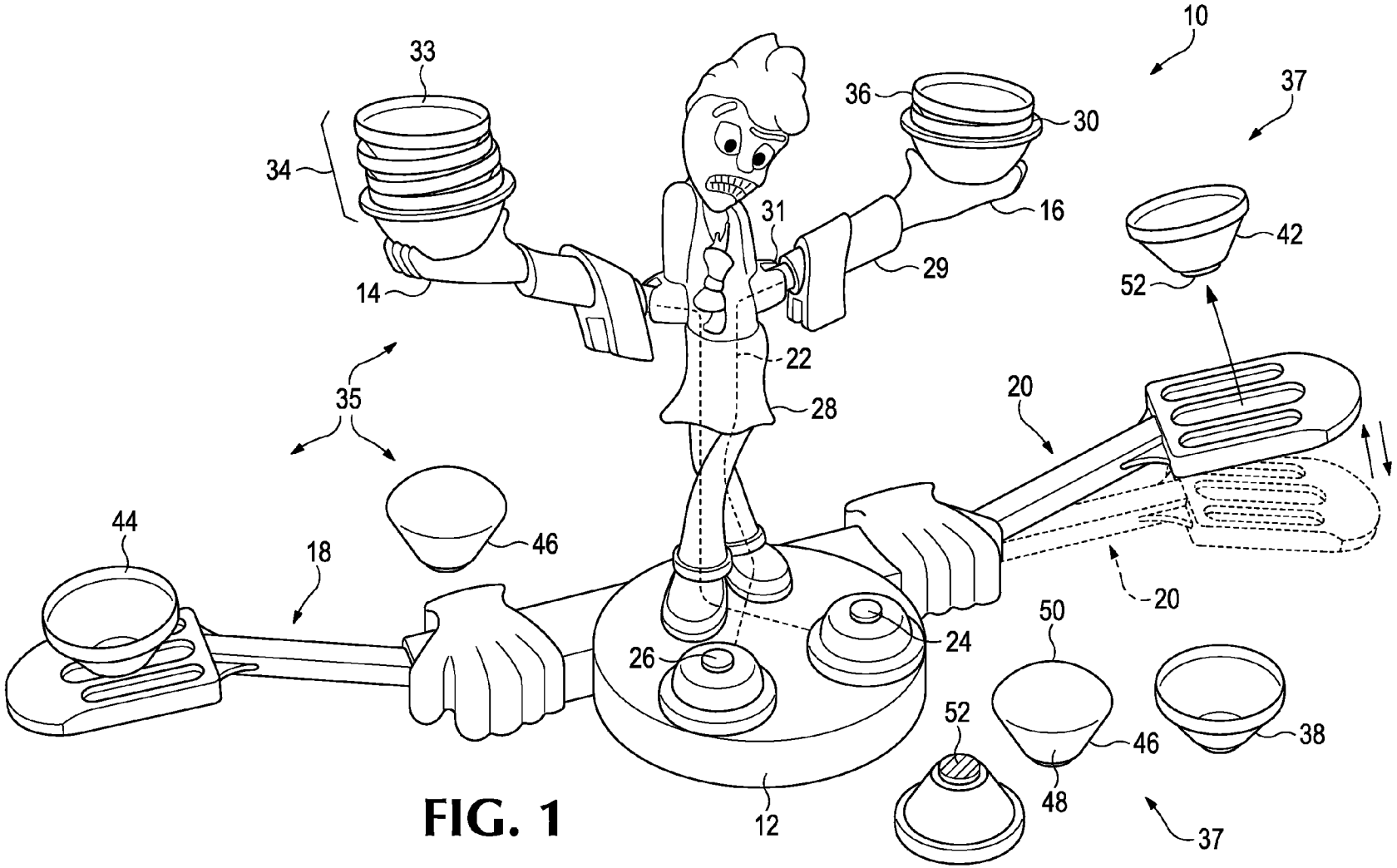
FIG. 1 is a top perspective view of an apparatus for playing a game, showing a first target platform and a second target platform, each in a collecting position, and a first launcher and a second launcher, each in a loading position, and a plurality of projectiles, in accordance with the present disclosure.
Figures 2, 3, 4:
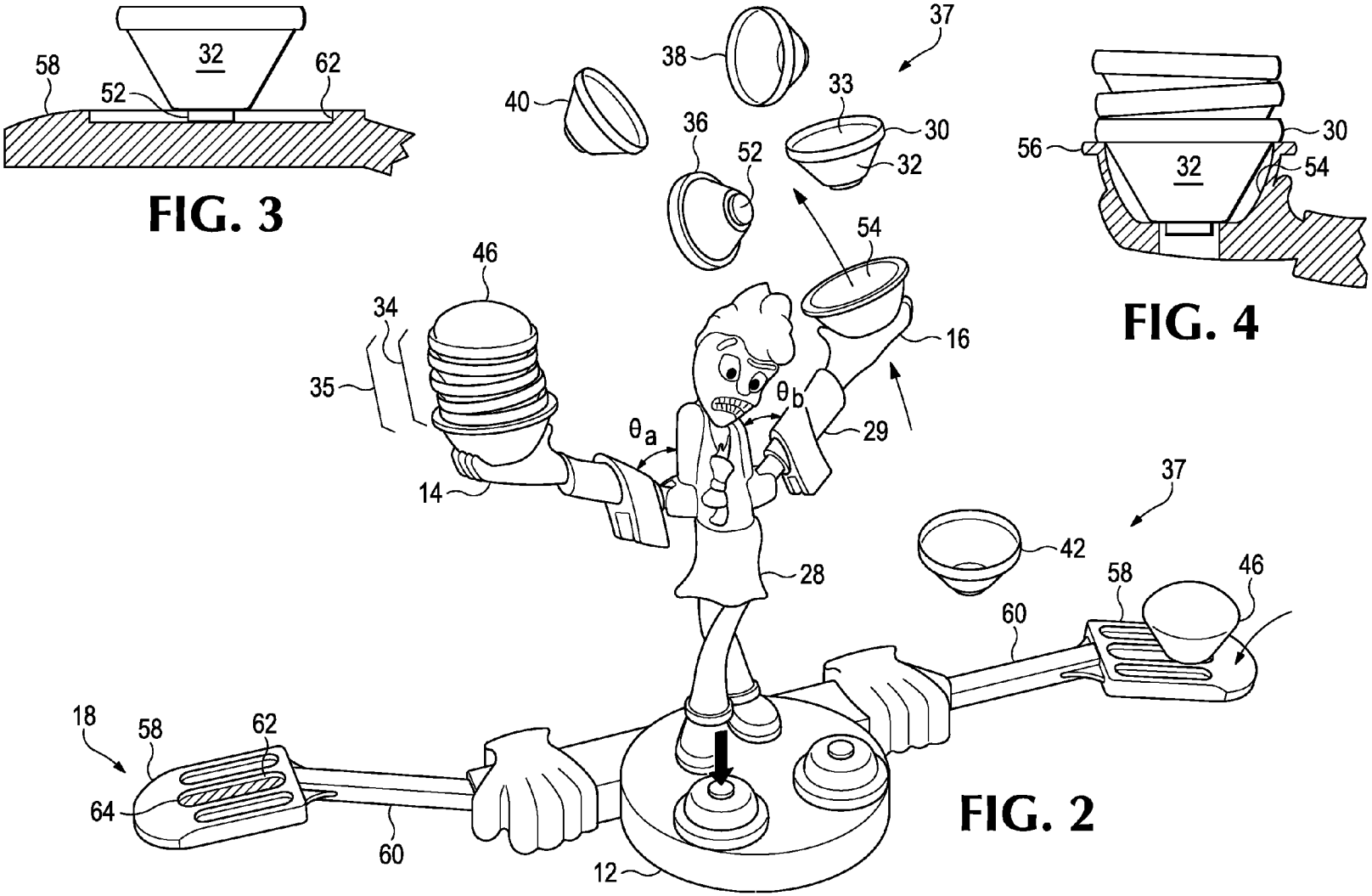
FIG. 2 is a top perspective view of the apparatus of FIG. 1, showing the second target platform in a dispersing position and the second launcher in a launched position, in accordance with the present disclosure.
FIG. 3 is a partial section side view of the apparatus of FIG. 1, showing a portion of the first launcher and a projectile in accordance with the present disclosure.
FIG. 4 is a partial section side view of the apparatus of FIG. 1, showing a portion of the first target platform and a stack of three projectiles in accordance with the present disclosure.

FIGS. 1 and 2 show an exemplary apparatus for playing a game, indicated generally at 10. Apparatus 10 may include a base 12 and at least one target platform, for example a first target platform 14 and a second target platform 16. Apparatus 10 may further include at least one launcher, for example a first launcher 18 and a second launcher 20.

Some embodiments of the present disclosure may be described as a target game 10 to simulate a busy fast food worker flipping burgers and stacking a sandwich made up of a bottom bun, a burger patty, a selection of toppings, and a top bun by catapulting these parts of a sandwich onto a tray 14, 16 in the worker's hands. Preferably two catapults 18, 20 are provided for two-player competition, on either side of the simulated fast food worker. The first player to assemble a proper sandwich on the proper tray 14, 16 pushes a mechanical button which pushes on a push rod connecting the childpowered force to the opponent's hand, throwing the opponent's stack of burger parts into the air and onto the supporting table or floor.

Some embodiments of apparatus 10 may include an actuator mechanism 22. Actuator mechanism 22 may be configured to actuate movement of one or both of first and second target platforms 14, 16. Actuator mechanism 22 may include a first release member 24 (a mechanical button) mounted to base 12. First release member 24 may be operably connected to first target platform 14. First release member 24 may be configured to trigger movement of first target platform 14. Actuator mechanism 22 may include a second release member 26 mounted to base 12. Second release member 26 may be operably connected to second target platform 16. The second release member 26 may be configured to trigger movement of second target platform 16. First release member 24 may be disposed substantially adjacent second launcher 20 and second release member 26 may be disposed substantially adjacent first launcher 18.

One or both of first and second target platforms 14, 16 may be disposed above base 12. For example, first and second target platforms 14, 16 may be attached to a target support member 28 (a simulated busy fast food worker) mounted to base 12 such that first and second target platforms 14, 16 are supported above base 12. Additionally and/or alternatively, first and second target platforms 14, 16 may be hingedly attached to the target support member such that first and second target platforms 14, 16 are supported above base 12. The target support member may be disposed between first and second target platforms 14, 16.

In some embodiments, one or both of first and second target platforms 14, 16 may be spaced from target support member 28. For example, apparatus 10 may include one or more arms 29 that may be attached to first or target second platforms 14, 16 at a first end and moveably attached to the target support member at a second end, for example via a hinge 31. Arms 29 may extend from target support member 28 at a first acute angle øa in the collecting position and a second acute angel øb in the dispersing position.

Apparatus 10 may include at least one projectile 30, also referred to as first projectile 30. Projectile 30 may include a convex surface 32 and/or a concave surface 33. For example, first projectile 30 may include a bowl or semi-spherical shape. One or both of the first and second sets of projectiles may additionally and/or alternatively include a plurality of projectiles configured to collect at first and second target platforms 14, 16 as a stack of projectiles 34. Stack of projectiles 34 may include a height, which may vary depending on the configuration of each projectile and/or the number of projectiles in the stack. For example, in addition or alternative to first projectile 30, each set of projectiles may include two or more of a second projectile 36, a third projectile 38, a fourth projectile 40 and/or a fifth projectile 42, collectively referred to as stackable projectiles 36, 38, 40 and 42. As explained in further detail below, the plurality of projectiles may also include a finisher projectile 46.

One or both of first and second target platforms 14, 16 may be moveable with respect to base 12. For example, one or both of first and second target platforms 14, 16 may include a collecting position, in which the plurality of projectiles are collected at first or second target platform 14, 16, and a dispersing position, in which the plurality of projectiles are dispersed from first or second target platform 14, 16. In the embodiment shown in FIG. 1, first and second target platforms 14, 16 are shown in the collecting position. In the embodiment shown in FIG. 2, first target platform 14 is shown in the collecting position and second target platform 16 is shown in the dispersing position.

For example, actuator mechanism 22 may be configured to actuate movement of one or both of first and second target platforms 14, 16 from the collecting position to the dispersing position. Actuator mechanism may be substantially disposed in one or both of base 12 and target support member 28.

In some embodiments, the one or more projectiles may be divided into a first set of projectiles 35 and a second set of projectiles 37, alternatively described as a set of projectiles for each target platform and/or for each launcher. Each set of projectiles 35, 37 may include an equal number of projectiles, for example a single projectile or a plurality of projectiles. The projectiles may have a uniform shape or may be differently configured from one another.

For example, as shown in the embodiment depicted in FIGS. 1 and 2, each set of projectiles 35, 37 may include six projectiles. One or both of the first and second set of projectiles 35, 37 may include at least one projectile 30 that may be configured to be retained by the first and/or second target platform.

Stackable projectiles 36, 38, 40 and 42 may be configured to be stackable on first projectile 30, on top of the other and/or may be configured to be stacked at the first and second target areas 14, 16. Stackable projectiles 36, 38, 40 and 42 may be shaped similarly to first projectile 30. For example, one or more of stackable projectiles 36, 38, 40 and 42 may include a bowl or semi-spherical shape having convex surface 32 and/or concave surface 33. Additionally and/or alternatively, one or more of stackable projectiles 36, 38, 40 and 42 may include rim member 44 extending upwardly from convex surface 32 and/or concave surface 33.

Additionally and/or alternatively, one or both of the first and second set of projectiles 35, 37 may include a sixth projectile 46, also referred to as a finisher projectile 46. Finisher projectile 46 may be stackable on top of another projectile. Finisher projectile 46 may be distinguishable from the other projectiles and/or may be configured such that no additional projectiles may be stacked on top of finisher projectile 46.

For example, finisher projectile 46 may include a first convex surface 48 that is configured to be retained by concave surface 33 of first projectile 30 or stackable projectiles 36, 38, 40 and 42, and a second convex side 50. Accordingly, finisher projectile 46 may not be stackable under the other projectiles. In other words, first projectile 30 or stackable projectiles 36, 38, 40 and 42 may not be stacked on top of finisher projectile 46; however, finisher projectile 46 may stack on top of first projectile 30 or stackable projectiles 36, 38, 40 and 42.

In some embodiments, one or more of first projectile 30, stackable projectiles 36, 38, 40 and 42, and/or finisher projectile 46 may include a grip 52 that may be configured to aid in retention of the projectile at first and second target platforms 14, 16. Additionally and/or alternatively, grip 52 may aid in the launching of first projectile 30, stackable projectiles 36, 38, 40 and 42, and/or finisher projectile 46 from first and second launchers 18, 20. Grip 52 may include a raised portion or a detent portion, for example a raised circular disk. Grip 52 may also include a textured surface and/or add weight such that first projectile 30, stackable projectiles 36, 38, 40 and 42, and/or finisher projectile 46 tends to fall with the bottom of convex surface 32 or first convex side 48 facing downward.

One or both of first and second target platforms 14, 16 may be configured to collect one or more of first projectile 30, stackable projectiles 36, 38, 40 and 42, and/or finisher projectile 46. For example, as shown in the sectional view of one of first and second target platforms 14, 16 and a projectile in FIG. 4, first and second target platforms 14, 16 may include a cavity 54, such as a semi-spherical depression. Cavity 54 may be configured to at least partially retain convex surface 32 or first convex side 48 of first projectile 30, stackable projectiles 36, 38, 40 and 42, and/or finisher projectile 46. Additionally and/or alternatively, cavity 54 may be configured to retain substantially all of convex surface 32 or first convex side 48 of first projectile 30, stackable projectiles 36, 38, 40 and 42, and/or finisher projectile 46.

One or both of first and second target platforms 14, 16 may additionally and/or alternatively include a lip 56, also referred to as an outer ring or skirt. All or a portion of first and second target platforms 14, 16 may be configured such that the projectiles that do not properly land on first and second target platforms 14, 16, slide off of platforms 30, 32. For example, in some embodiments lip 56 may tilt to one side such that the projectiles that do not land in cavity 54 slide off of lip 56.

One or both of the first and second launchers 18, 20 may be attached to base 12 and/or may be configured to project first projectile 30, stackable projectiles 36, 38, 40 and 42, and/or finisher projectile 46 toward first and second target platforms 14, 16, respectively. First and second launchers 18, 20 may be attached to opposite sides of base 12 and/or may be disposed at least partially underneath first and second target platforms 14, 16 respectively. First and second launchers 18, 20 may be moveable from a loading position to a launched position. For example, FIG. 1 shows first and second launchers 18, 20 in the loading position and FIG. 2 shows first launcher 18 in the launched position and second launcher 20 in the loading position.

One or both of first and second launchers 18, 20 may be biased to move from the loading position to the launched position and/or may include a spring. One or both of first and second launchers 18, 20 may be actuated by an external force pushing down on one or both of first and second launchers 18, 20 to the loading position (shown in relief in FIG. 1) and the external force releasing one or both of first and second launchers 18, 20 causing the launcher to thrust upwards to the launched position.

First and second launchers 18, 20 may include any means for launching first projectile 30, stackable projectiles 36, 38, 40 and 42, and/or finisher projectile 46 toward first and second target areas 14, 16 known to those skilled in the art. For example, each of first and second launchers 18, 20 may include a launch platform 58 and a lever 60. Launch platform 58 may be configured such that first projectile 30, stackable projectiles 36, 38, 40 and 42, and/or finisher projectile 46 land on and/or near first and second target platform 14, 16 when launch platform 58 is moved from the ready-to-launch to the launched position.

Launch platform 58 may include a length and the projectile is positionable along the length of launch platform 58, depending on the height of stack of projectiles 34 at first and second target platforms 14, 16. Additionally and/or alternatively, one or more of first projectile 30, stackable projectiles 36, 38, 40 and 42, and/or finisher projectile 46 may be positionable along the length of launch platform 58, to alter the trajectory of the launched projectile.

Launch platform 58 may include means for balancing or holding first projectile 30, stackable projectiles 36, 38, 40 and 42, and/or finisher projectile 46. For example, launch platform 58 may include one or more slots 62 configured to at least partially contain grip 52, thereby balancing first projectile 30, stackable projectiles 36, 38, 40 and 42, and/or finisher projectile 46 before launch. Slot 62 may include a textured surface.

As noted above, the preferred placement of first projectile 30, stackable projectiles 36, 38, 40 and 42, and/or finisher projectile 46 on launch platform 58 may be dependent on the number and/or height of projectiles already stacked at target platforms 14, 16. For example, the preferred placement of finisher projectile 46 may be at a distal end 64 of platform 58. The preferred placements may also be indicated via decals (not shown) on platform 58. In some embodiments, launch platform 58 may further include one or more positive stop ridges (not shown). The positive stop ridges may indicate preferred placement of first projectile 30, stackable projectiles 36, 38, 40 and 42, and/or finisher projectile 46 on platform 58.

Turning now to FIG. 2, as noted earlier, first and second target areas 14, 16 may be moveable between the collecting position and the dispersing position. Activation and/or depression of one of target release members 24, 26 may release one of first and second target areas 14, 16 from the collecting position to the dispersing position. In the collecting position, target platform 14, 16 may be substantially horizontal or other wise configured such that a projectile may land and stay on target platform 14, 16. In the dispersing position, target platform 14, 16 may be at an angle such that stack of projectiles 34 are dispersed or dumped on the floor. In FIG. 2, first target platform 14 is in the collecting position and second target platform 16 is in the dispersing position.

As noted above, actuator mechanism 22 may be configured to actuate movement of first and second target platforms 14, 16 from the collecting position to the dispersing position. Actuator mechanism 22 may include a push rod assembly operably connected to the first and second target areas and the corresponding release members 24, 26. Mechanical energy may be translated by depressing first and/or second release members 24, 26, actuating the push rod assembly, which moves the corresponding target platform 14, 16 from the collecting position to the dispersing position. Alternatively, first and second target areas 14, 16 may be biased toward the dispersing position such that the force of the bias causes the set of projectiles to either disperse upward or over target column 28. Additionally and/or alternatively, the dispersing position may cause the set of projectiles to disperse downwards.

Figure 5:
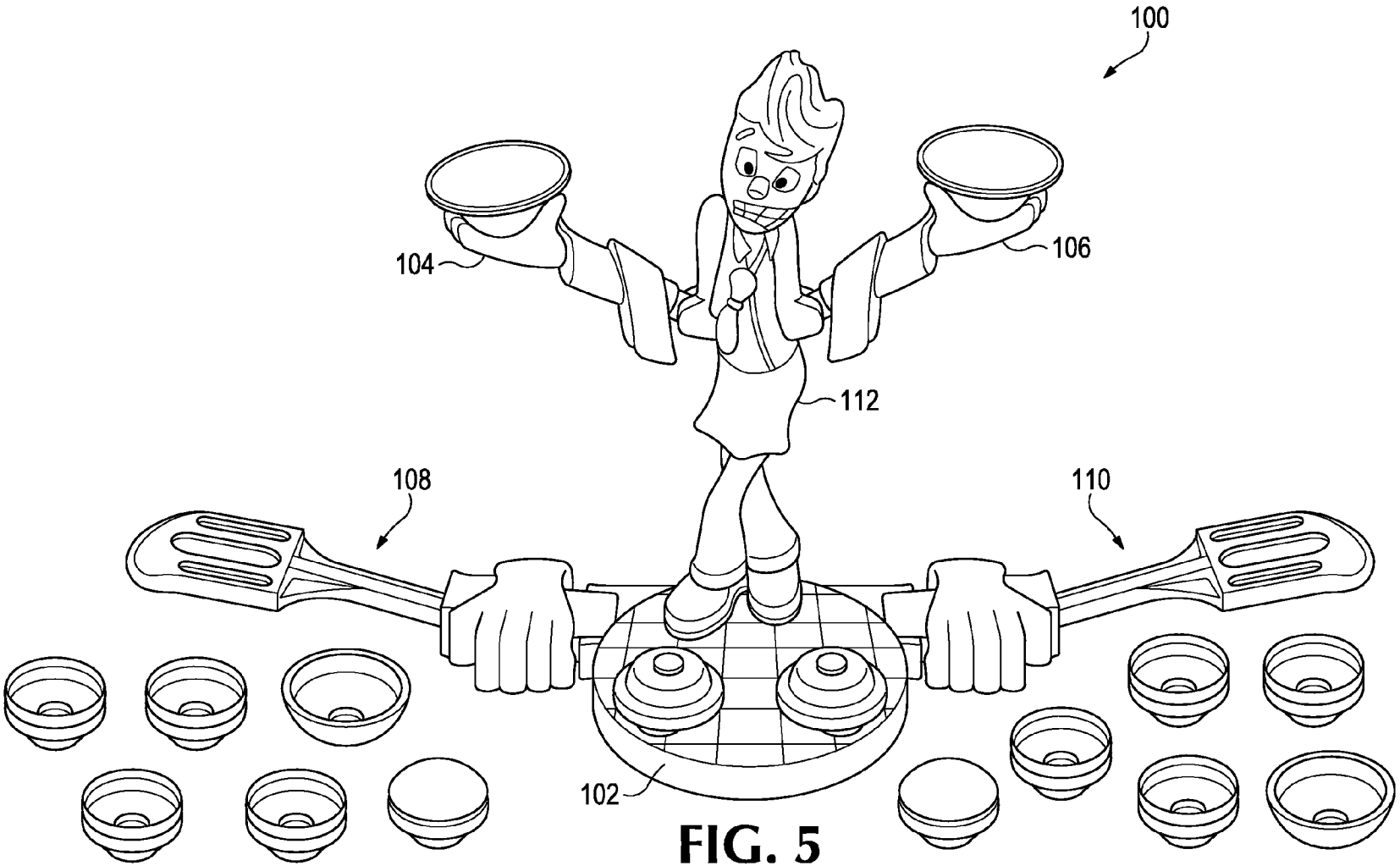
FIG. 5 is a top perspective view of an apparatus for playing a game, showing a first target platform, a second target platform, a first launcher, a second launcher, a base and a target support member, in accordance with the present disclosure.
Figure 6:
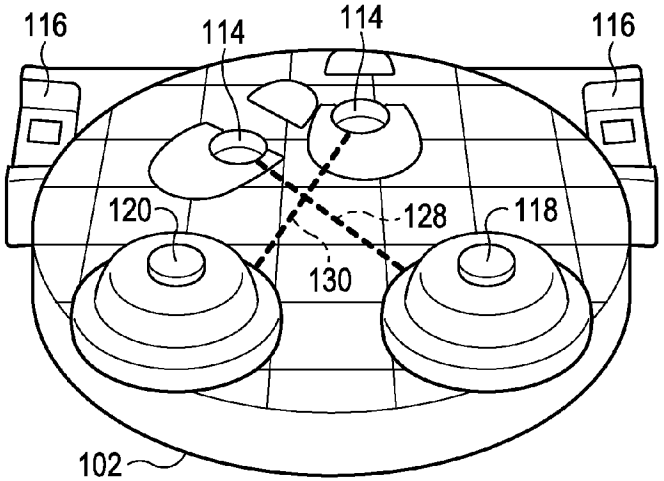
FIG. 6 is a partial view of the apparatus of FIG. 5, showing the base, in accordance with the present disclosure.

FIGS. 5-8 show various views of an apparatus for playing a game, indicated generally at 100. As shown in FIG. 5, apparatus 100 may include a base 102, a first target platform 104, a second target platform 106, a first launcher 108, a second launcher 110 and a target support member 112. As shown in FIG. 6, base 102 may include two actuator mechanism apertures 114, two launcher apertures 116, first target release member 118 and a second target release member 120.

Figure 7:
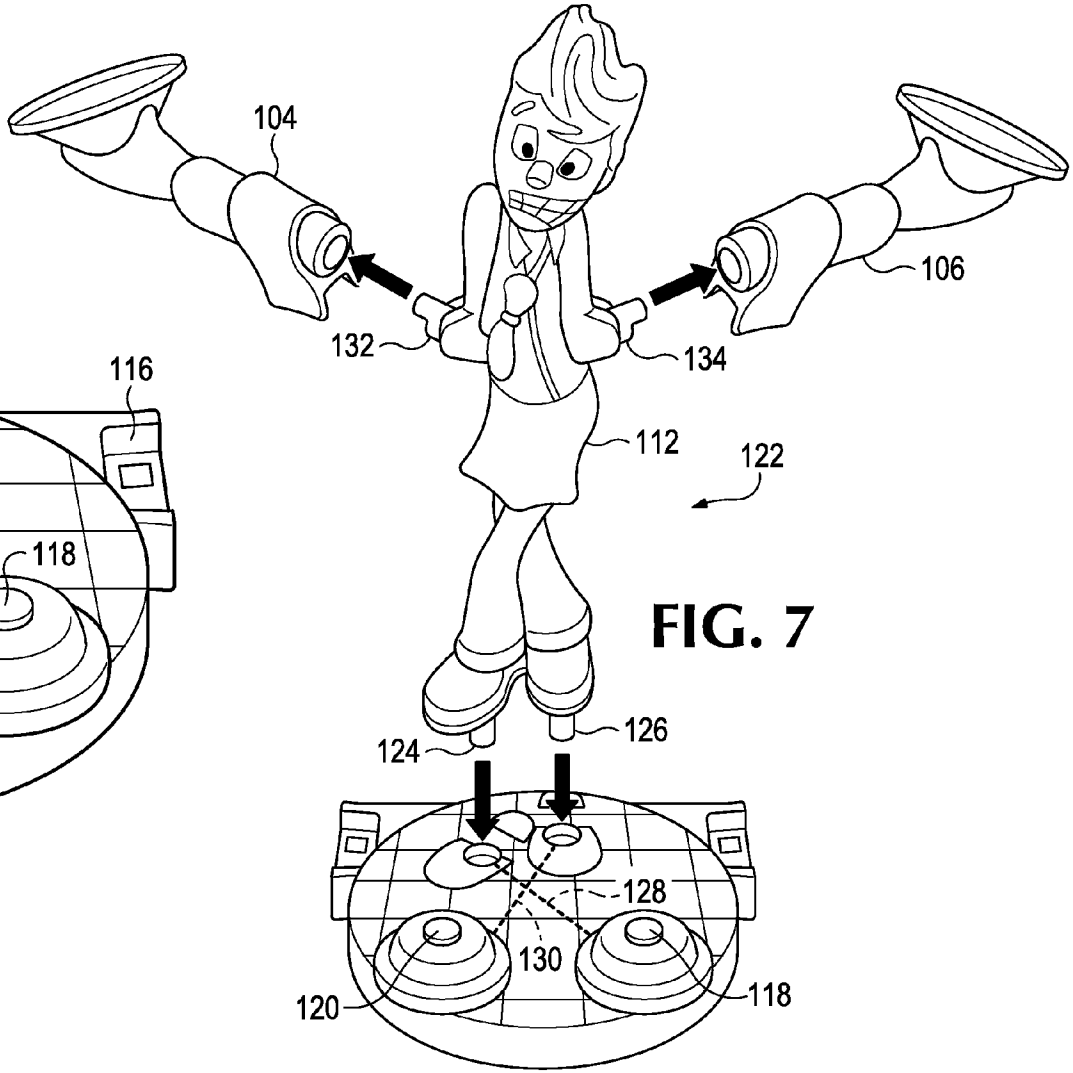
FIG. 7 is a partial front exploded view of the apparatus of FIG. 5, showing the first target platform and the second target platform, the target support member, and the base, in accordance with the present disclosure.

Apparatus 100 may include an actuator assembly 122. Actuator assembly 122 may include a push rod assembly including a first rod 124 and a second rod 126. First rod 124 may be operably connected to first release member 118 for example by a first lever 128, such that depression of first release member 118 causes first lever 128 to move first rod 124 upwards. Second rod 126 may be operably connected to second release member 120 for example by a second lever 130, such that depression of second release member 120 causes second lever 130 to move second rod 126 upwards. As shown in FIG. 7, two actuator mechanism apertures 114 may be configured to receive first rod 124 and second rod 126.

Actuator assembly 122 may further include a first hinging member 132 and a second hinging member 134. First hinging member 132 may be attached to first target platform 104 and second hinging member 134 may be attached to second target platform 106. First rod 124 may be operably connected to first hinging member 132, such that movement of first rod 124 actuates first hinging member 132 and first target platform 104 to hingedly move upwards. Second rod 126 may be operably connected to second hinging member 134, such that movement of second rod 126 actuates second hinging member 134 and second target platform 106 to hingedly move upwards.

Figure 8:
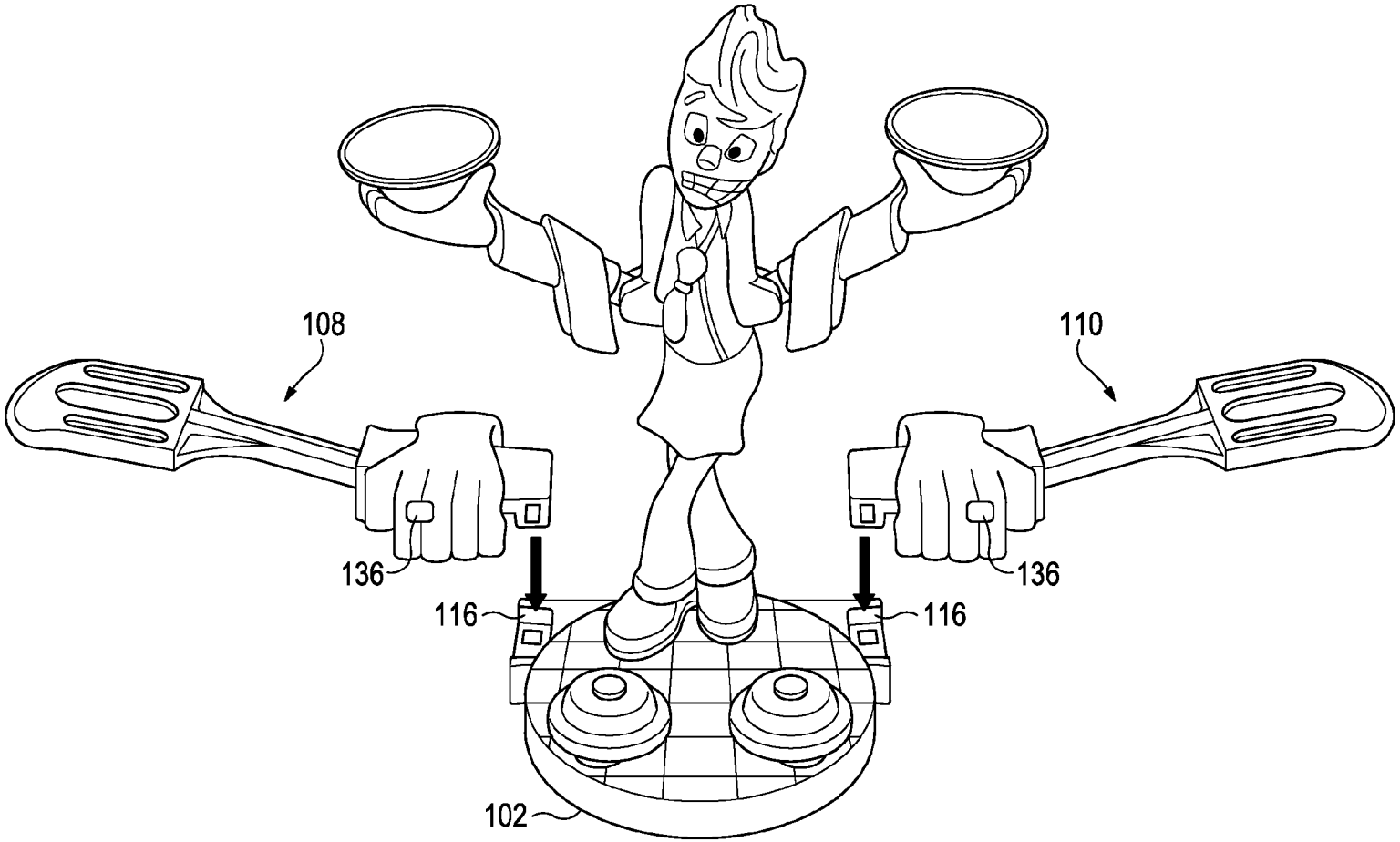
FIG. 8 is a partial front exploded view of the apparatus of FIG. 5, showing the first launcher, the second launcher, and the base, in accordance with the present disclosure.

As shown in FIG. 8, first launcher 108 and second launcher 110 may be insertable in launcher apertures 116. Each of first launcher 108 and second launcher 110 may include a biasing member 136 such as a spring, biasing first launcher 108 and second launcher 110 from a ready to launch position into a launched position.

Operation of an exemplary embodiment of a target game in accordance with the present disclosure may be described as follows. In operation, a first player and a second player may be initially provided with a set of projectiles each. The first and second players then manipulate a first and a second launcher respectively to launch the projectiles onto a first and a second target platform respectively. Accordingly, the projectiles may stack up at designated player target platforms. For example, the first player may load a projectile on the first launcher, move the launcher into a ready to launch position and release the launcher. The projectile may then land in and be at least partially retained by first target platform.

The final projectile launched may be a finisher projectile. The first player to stack finisher projectile at the top of the other projectiles at the target platform may activate his or her target release button, thereby causing the opposing player's target area to move from a collecting position to a dispersing position. The player who stacks all of his or her set of projectiles at his or her designated target area is the winner.

Additionally and/or alternatively, a particularly fun play pattern using the game in accordance with the present disclosure may be described as follows. The method may include launching a plurality of projectiles at a first target platform in a collecting position such that a stack of projectiles accumulates at first target platform and moving a second target platform from a collecting position to a dispersing position. In some embodiments, moving a second target platform may include activating a quick release mechanism. In this pattern of play, winning the game may include moving the second target platform to the dispersing position.

Some embodiments of the present disclosure may be described as a game including one or more launchers for projectiles and/or one or more target areas. In one embodiment, the game may include a first target area and a second target area, each target area including a semi-circular depression, a plurality of stackable projectiles, each projectile configured to fit within the semi-circular depression, and a first launcher and a second launcher, wherein the first launcher propels projectiles toward the first target area and the second launcher propels projectiles toward the second target area.

Additionally and/or alternatively, a game in accordance with the present disclosure may be described as a game that may include a first target area and a second target area, each target area moveable between a collecting position and a dispersing position, and a first launcher and a second launcher, wherein the first launcher propels projectiles toward the first target area and the second launcher propels projectiles toward the second target area. Some embodiments of the game may include a target quick release mechanism, wherein the quick release mechanism moves one of the first and second target areas from the collecting position to the dispersing position. Moving one of the target areas from the collecting position to the dispersing position preferably causes all contents of the one of the target areas to fall and spill all over the ground, table, or other supporting surface for the toy.

The various components of a target game may be fabricated from any suitable material, such as plastic, foamed plastic, flexible plastic, one or more layers of fabric, wood, cardboard, pressed paper, metal, or any combination of materials. A suitable material or combination of materials may be selected to provide a desirable synergy of weight, strength, durability, cost, and/or manufacturability.

While embodiments of a toy and methods of toy play have been particularly shown and described, many variations may be made therein. This disclosure may include one or more independent or interdependent embodiments directed to various combinations of features, functions, elements and/or properties. Other combinations and sub-combinations of features, functions, elements and/or properties may be claimed later in a related application. Such variations, whether they are directed to different combinations or directed to the same combinations, whether different, broader, narrower or equal in scope, are also regarded as included within the subject matter of the present disclosure. Accordingly, the foregoing embodiments are illustrative, and no single feature or element, or combination thereof, is essential to all possible combinations that may be claimed in this or a later application.

It is believed that the disclosure set forth herein encompasses multiple distinct inventions with independent utility. While each of these inventions has been disclosed in its preferred form, the specific embodiments thereof as disclosed and illustrated herein are not to be considered in a limiting sense as numerous variations are possible. Each example defines an embodiment disclosed in the foregoing disclosure, but any one example does not necessarily encompass all features or combinations that may be eventually claimed. Where the description recites "a" or "a first" element or the equivalent thereof, such description includes one or more such elements, neither requiring nor excluding two or more such elements. Further, ordinal indicators, such as first, second or third, for identified elements are used to distinguish between the elements, and do not indicate a required or limited number of such elements, and do not indicate a particular position or order of such elements unless otherwise specifically stated.

We claim:

1. An apparatus for playing a game, the apparatus comprising:

a base;

a plurality of projectiles;

a first target platform moveable with respect to the base, the first target platform including a collecting position, in which the plurality of projectiles are collected at the first target platform as a stack of projectiles, and a dispersing position, in which the plurality of projectiles are dispersed from the first target platform;

an actuator mechanism configured to actuate movement of the first target platform from the collecting position to the dispersing position; and a first launcher attached to the base and configured to project a projectile toward the first target platform, where the first launcher includes a launch platform having a length, and the projectile is positionable along the length of the launch platform, to alter the trajectory of the launched projectile.

2. The apparatus of claim 1, wherein the actuator mechanism includes a first release member mounted to the base.

3. The apparatus of claim 1, wherein at least one of the projectiles includes a convex surface; and the first target platform includes a target cavity configured to at least partially retain the convex surface of the at least one of the projectiles.

4. The apparatus of claim 1, further comprising:

a second target platform moveable with respect to the base, the second target platform including a collecting position, in which the plurality of projectiles are collected at the second target platform, and a dispersing position, in which the plurality of projectiles are dispersed from the second target platform; and a second launcher attached to the base and configured to project the projectile towards the second target platform.

5. The apparatus of claim 4, wherein the actuator mechanism is further configured to actuate movement of the second target platform from the collecting position to the dispersing position;

the actuator mechanism including a second release member mounted to the base.

6. The apparatus of claim 1, further comprising a target support member mounted to the base;

wherein the first target platform is hingedly attached to the target support member such that the first target platform is supported above the base.

7. The apparatus of claim 1, wherein the first launcher is biased to move from a loading position to a launched position.

8. An apparatus for playing a game, the apparatus comprising:

a base;

a plurality of projectiles, at least one of the projectiles projectile including a convex surface;

a first target platform moveable with respect to the base and including a target cavity configured to at least partially retain the convex surface of the at least one projectile;

an actuator mechanism configured to actuate movement of the first target platform; and a first launcher attached to the base and configured to project the projectiles toward the first target platform;

wherein the plurality of projectiles are configured to collect at the target cavity of the first target platform as a free-standing stack of projectiles.

9. The apparatus of claim 8, wherein the first target platform includes a collecting position, in which the projectile is collected at the first target platform, and a dispersing position the projectile is dispersed from the first target platform; and the actuator mechanism is configured to actuate movement of the first target platform from the collecting position to the dispersing position.

10. The apparatus of claim 8, wherein the actuator mechanism includes a first release member mounted to the base.

11. The apparatus of claim 8, wherein the first launcher includes a launch platform having a length, and the projectile is positionable along the length of the launch platform, to alter the trajectory of the launched projectile.

12. The apparatus of claim 8, further comprising:

a second target platform moveable with respect to the base and including a target cavity configured to at least partially retain the convex surface of the projectile; and a second launcher attached to the base and configured to project the projectile toward the second target platform;

the actuator mechanism further configured to actuate movement of the second target platform.

13. The apparatus of claim 8, further comprising a target support member mounted to the base;

wherein the first target platform is hingedly attached to the target support member such that the first target platform is supported above the base.

14. An apparatus for playing a game, the apparatus comprising:

a base;

a plurality of projectiles, at least one of the projectiles including a convex surface;

a first target platform disposed above the base and including a target cavity configured to at least partially retain the convex surface of the at least one of the projectiles;

a second target platform disposed above the base and including a target cavity configured to at least partially retain the convex surface of the at least one of the projectiles;

a first launcher attached to the base and configured to project the plurality of projectiles to the first target area such that a stack of projectiles is collected at the first target area; and a second launcher attached to the base and configured to project the plurality of projectiles to the second target area such that a stack of projectiles is collected at the second target area wherein the first and second launchers each include a launch platform having a length, and the projectile is positionable along the length of the launch platform, to alter the trajectory of the launched projectile.

15. The apparatus of claim 14, further comprising a platform support;

wherein the first and second target platforms are hingedly mounted to the platform support such that the first and second target platforms are moveable with respect to the base.

16. The apparatus of claim 15, further comprising an actuator mechanism configured to actuate movement of the first and second target platforms from a collecting position to a dispersing position;

the actuator mechanism including a first release member and a second release member.

17. An apparatus for playing a game, the apparatus comprising:

a base;

a plurality of projectiles, at least one of the projectiles including a convex surface;

a first target platform moveable with respect to the base and including a target cavity configured to at least partially retain the convex surface of the at least one of the projectiles, wherein the plurality of projectiles are configured to collect at the first target platform as a stack of projectiles;

an actuator mechanism configured to actuate movement of the first target platform; and a first launcher attached to the base and configured to project the projectiles toward the first target platform, wherein the first launcher includes a launch platform having a length, and the projectiles are positionable along the length of the launch platform, to alter the trajectory of the launched projectiles.

18. The apparatus of claim 17, wherein the first target platform includes a collecting position, in which the projectiles are collected at the first target platform, and a dispersing position in which the projectiles are dispersed from the first target platform; and the actuator mechanism is configured to actuate movement of the first target platform from the collecting position to the dispersing position.

19. The apparatus of claim 17, further comprising:

a second target platform moveable with respect to the base and including a target cavity configured to at least partially retain the convex surface of the at least one of the projectiles, wherein the plurality of projectiles are configured to collect at the second target platform as a stack of projectiles; and a second launcher attached to the base and configured to project the projectile toward the second target platform, wherein the second launcher includes a launch platform having a length, and the projectiles are positionable along the length of the launch platform, to alter the trajectory of the launched projectiles; and the actuator mechanism is further configured to actuate movement of the second target platform.

20. The apparatus of claim 17, further comprising a target support member mounted to the base;

wherein the first target platform is hingedly attached to the target support member such that the first target platform is supported above the base.

* * * * *